United States Patent [19]

Farley

[11] 3,971,592

[45] July 27, 1976

[54] CHAIR FOR AIDING CONJUGAL RELATIONS FOR THE INFIRM

[76] Inventor: Brent Farley, 4215 Connecticut Ave., Baltimore, Md. 21229

[22] Filed: Sept. 26, 1974

[21] Appl. No.: 509,643

[52] U.S. Cl. ..... 297/217; 5/327 R; 297/445

[51] Int. Cl.[2] ..... A47C 7/62

[58] Field of Search ..... 4/134; 248/172, 419, 248/424; 297/42, 44, 45, 217, 344, 345, 350, 351, 354, 355, 383, 374, 439, 445; 5/327 R

[56] References Cited

UNITED STATES PATENTS

| | | | |
|---|---|---|---|
| 1,248,113 | 11/1917 | Henning et al. | 4/134 |
| 2,722,692 | 11/1955 | Dempster | 5/327 R |
| 2,797,738 | 7/1957 | Patterson | 297/345 |
| 2,805,776 | 9/1957 | Levitan | 248/172 X |
| 3,668,722 | 6/1972 | Gallant | 5/327 R |
| 3,711,152 | 1/1973 | Sirpak et al. | 297/345 X |

*Primary Examiner*—James C. Mitchell
*Attorney, Agent, or Firm*—Stevens, Davis, Miller & Mosher

[57] ABSTRACT

A chair intended to aid conjugal relations for the infirm is disclosed having a frame with front, back and side members, the front and back members being adjustable to expand the width of the chair. A covering or seat contains an orifice in the region of the center of the covering or seat. In a preferred embodiment, an adjustable chair back can be pivoted down to lay flush with the frame to present a greater surface area. In another embodiment, the legs are also adjustable.

10 Claims, 3 Drawing Figures

CHAIR FOR AIDING CONJUGAL RELATIONS FOR THE INFIRM

The present invention relates to a chair. More particularly the invention concerns a chair designed to assist in conjugal relations for the infirm.

Many medical authorities acknowledge that conjugal relations are very beneficial from the health point of view and particularly aid in keeping the heart fit and the blood pressure at desirable levels. However, this therapy is often precluded if one of the partners has become infirm and the lack of such therapy will only aggravate the condition. Often many people with bad backs, bad hearts, high blood pressure or suffering from overweight or having an amputated limb refrain from conjugal relations due to an apprehension, either justified or imagined, regarding the difficulties arising from body contact. Another problem is caused by the stress and strain put upon the body during conjugal relations. For some, especially those with bad hearts or high blood pressure combined with overweight, normal conjugal relations could hasten their demise.

Accordingly an object of the present invention is a chair which will aid conjugal relations for the infirm.

Moreover, an object of the present invention is a chair which will eliminate all but the necessary body contact in carrying out successful conjugal relations for the infirm.

One other object of the present invention is a chair for aiding conjugal relations for the infirm with a back member which can fold down and be locked in a position flush with the frame of the chair.

Yet another object of the present invention is a chair for aiding conjugal relations for the infirm which will alleviate the stress and strain occasioned by body weight during intercourse.

A further object of the present invention is a chair having an adjustable frame and adjustable leg members.

Another object of the invention is a chair for aiding conjugal relations for the infirm wherein the seat or covering has an orifice in the region of the center of the seat or covering.

The present invention can be more easily understood from a review of the drawings wherein FIG. 1 is an expanded view of the chair in accordance with the present invention;

Figure 1:
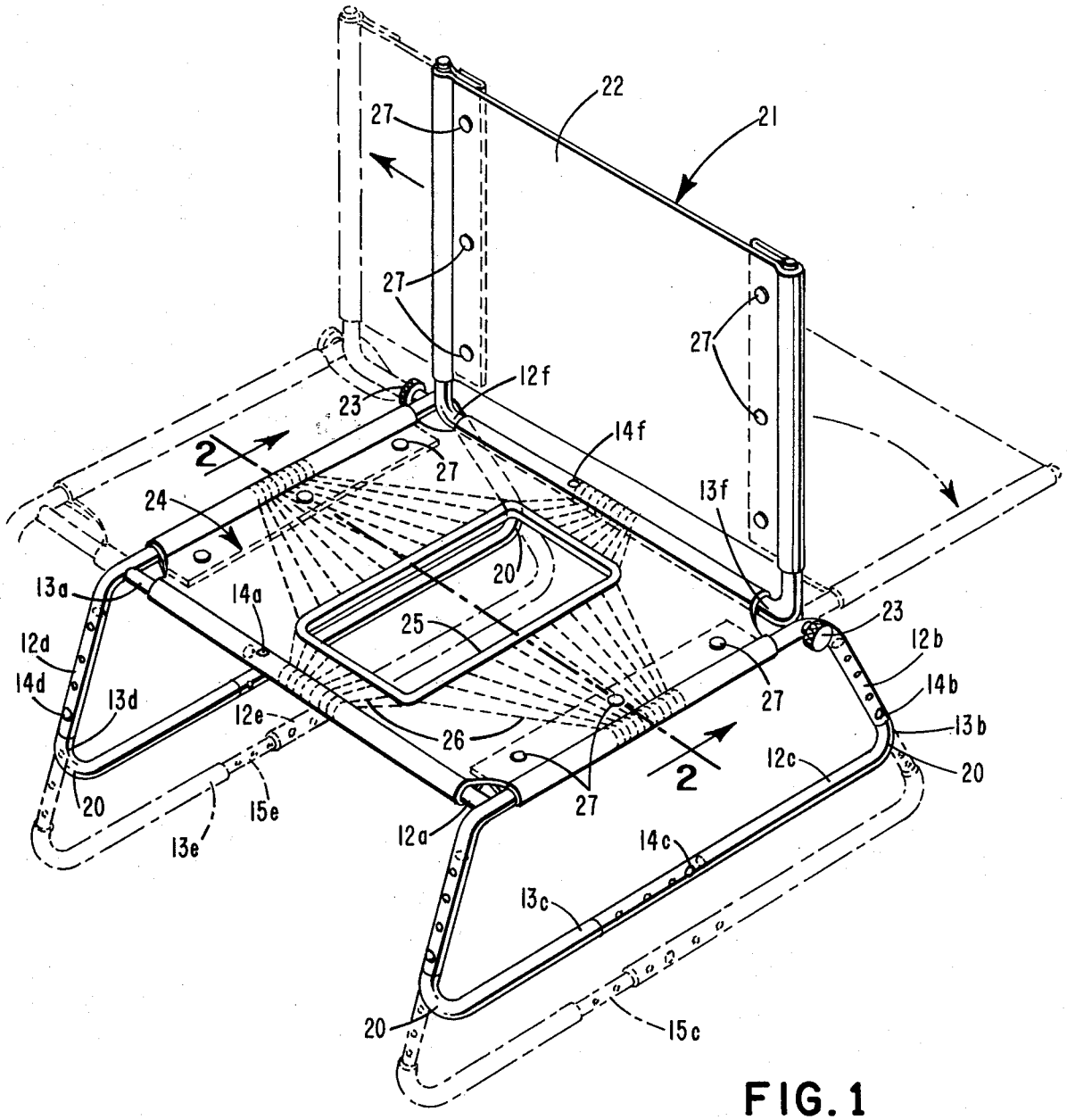

Referring to FIG. 1, a tubular member 12*a* is set out along the front of the frame and has an inner diameter sufficient to accommodate tube 13*a* which is locked in place by pins 14*a* which can run flush with the exterior surface or nearly flush with the exterior surface of tubular member 12*a*. In this embodiment the pins are placed through holes in the covering, which will be described in more detail infra.

Figure 3:
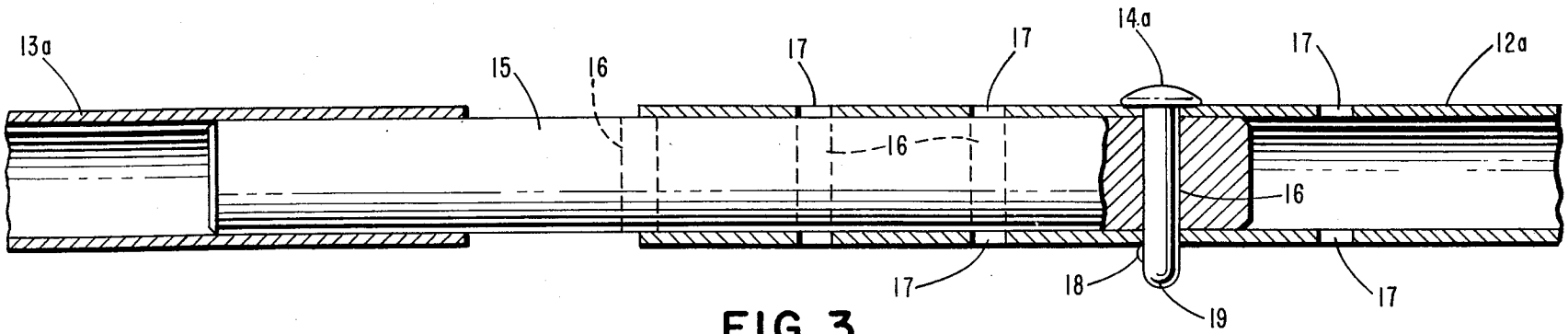
FIG. 3 is a longitudinal section along one of the tubular frame members of the chair in accordance with the present invention.

A more detailed view of the tubular frame member is shown in FIG. 3. This frame member can be used on the front and sides of the frame to give the chair its adjustable feature as well as on the legs of the chair. In the tubular frame member, tube 13*a* has a tube 15 of smaller diameter welded thereto and the tube of smaller diameter will easily slide within tubular member 12*a*. Holes 16 are drilled through smaller diameter tube 15 at convenient locations for adjustment which will line up with holes 17 drilled in tubular member 12*a* to accommodate pin 14*a*. The pin has a spring loaded ball-bearing 18 at the lower end of the shaft 19 to anchor the tubular frame member into place and to accommodate the adjustment.

In FIG. 1, the chair is shown in expanded condition along the front and the back members. While not shown in the drawing, it is apparent that a similar arrangement can be employed for the side members of the chair, if one desires to lengthen as well as widen the chair.

The legs are also adjustable to a desired set position by using a tubular member 12*b* into which is inserted tubular member 13*b* having an inner support as shown in FIG. 3. The legs are also shown in an expanded position in the Figure. Since the chair is intended to be placed upon a bed or similar object upon which one of the participants reclines, the adjustable legs have rounded ends 20 to prevent the bedding or the like from tearing. The rounded legs also help to distribute the weight of the other participant evenly across the surface of the object upon which the chair is placed. Since the locking members of the chair are similar for adjustment along the front, back, leg and bottom portions of the chair, members are depicted as 12*a*, 12*b*, 12*c* and the like. The method of adjustment is alike and is as shown in more detail in FIG. 3.

The chair has a back generally depicted as 21 which can be adjusted to expand as the seat and frame of the chair expand. This is possible due to the arrangement of the back section of the frame which is similar to that of the front. The back has a covering 22 made of a flexible material such as reinforced canvas and is adjustable to pass from a vertical to a horizontal position. In this manner the chair becomes similar to a cot and it allows the participant using the chair more area in which to lay down or sit. There is presented a greater surface area for the participant using the chair and enables the participant to be across the chair either face up or face down, rather than sitting on the chair. A thumb screw 23 is placed on the ends of the frame to lock the back in the upright or horizontal position.

The covering of the seat 24 is also made of flexible material such as reinforced canvas and has an orifice 25 in the region of the center of the covering. The covering is spread between the front and back and the side members of the frame and is held in place by means of attachment, one embodiment being depicted in FIG. 2 and discussed infra. Another material which can be used for the covering is a loosely structural but tightly woven interlocking material made of a plastic such as polyvinyl chloride. The orifice 25 is rectangular and should be wide and long enough to permit the chair to be used properly for the contemplated use. It is helpful to employ a reinforcing material in the covering to maintain stiffness. Heavy duty stitching 26 is shown extending from the orifice to the edges of the frame.

Figure 2:
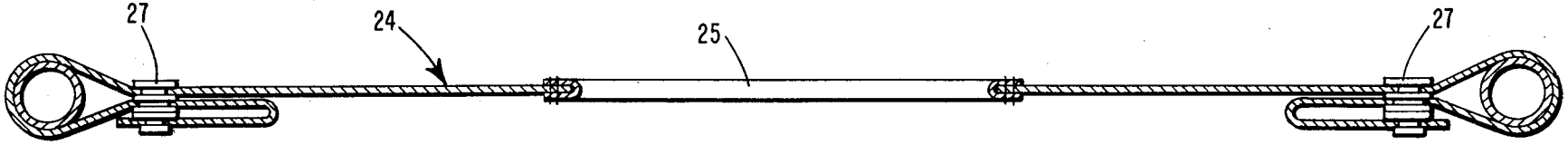
FIG. 2 is a sectional view of the seat along line 2—2 of FIG. 1.

FIG. 2 shows the covering of the seat and orifice attached to the tubular members at the side of the chair. When the chair is expanded, it is necessary that the covering of the seat (as well as the back) be expandable as well. If fabric such as canvas is used there is not a high degree of elasticity involved and considerations must be made to allow for expansion. Here, folds of the canvas are held in place by snap fasteners 27 which give added support to the chair along the edges of the frame. The folds can be expanded as the frame is expanded and can be folded as the frame is shortened.

To aid the participant sitting in the chair, arms also can be provided to maintain balance.

Having described a particular embodiment of the invention, it is apparent that other devices can be employed in order to achieve the desired ends and that the scope of the invention is limited only by the appended claims.

What is claimed is:

1. A chair for aiding conjugal relations for the infirm comprising:

a frame having a front member, a back member and two side members, said front and back members being adjustable to expand the width of the chair, legs attached to the frame at the corners and to each other to form a contact surface greater than the depth of the seat, and a covering spread between the front, sides and back members and surrounding portions of said members and having an orifice in the region of the center of the covering.

2. The chair of claim 1, wherein said members are comprised of interconnecting tubes and held in place by locking means.

3. The chair of claim 1, wherein said front and back members are held in place by a pin passing through interconnecting tubes forming the front and back members.

4. The chair of claim 1, wherein said covering is made of flexible material.

5. The chair of claim 1, wherein said legs are also adjustable.

6. The chair of claim 1, further comprising a back having a covering.

7. The chair of claim 1, wherein the covering is flexible.

8. The chair of claim 7, wherein the covering is a canvas covering.

9. The chair of claim 8, wherein the canvas covering is a stitch reinforced canvas covering.

10. The chair of claim 6 further comprising adjustment means and locking means at the intersection of the back and frame member for permitting the back to lay flush with the frame.

* * * * *